United States Patent [19]

Kenning

[11] Patent Number: 4,669,707

[45] Date of Patent: Jun. 2, 1987

[54] APPARATUS AND PROCESS FOR TAPPING MOLTEN METAL FURNACES USING A ROTARY PERCUSSION MILL

[75] Inventor: Jack C. Kenning, Huron, Ohio

[73] Assignee: Lakeway Manufacturing, Inc., Huron, Ohio

[21] Appl. No.: 794,163

[22] Filed: Nov. 1, 1985

[51] Int. Cl.[4] ..... C21C 5/46

[52] U.S. Cl. ..... 266/45; 266/271

[58] Field of Search ..... 266/45, 271, 287, 272; 75/41, 42

[56] References Cited

U.S. PATENT DOCUMENTS

| | | | |
|---|---|---|---|
| 4,273,202 | 6/1981 | Phillips et al. | 266/271 |
| 4,431,171 | 2/1984 | Foster | 266/45 |
| 4,436,285 | 3/1984 | Woodings | 266/45 |

FOREIGN PATENT DOCUMENTS

| | | | |
|---|---|---|---|
| 0025423 | 3/1981 | European Pat. Off. | 266/271 |

*Primary Examiner*—L. Dewayne Rutledge
*Assistant Examiner*—S. Kastler
*Attorney, Agent, or Firm*—Renner, Otto, Boisselle & Lyon

[57] ABSTRACT

An apparatus and process for tapping molten metal furnaces using a rotary percussion drill include a drilling rod assembly having a replaceable drilling section initially to drill the plugged tap hole to the furnace skull before being removed from the drill and being replaced by a one piece poking rod assembly to break the skull to tap the furnace. A cage assembly is pivotally mounted to the drive box of the drill to assist in alternately mounting the drilling rod assembly or poking rod assembly to the drive box and in cooperating with the drive box to provide the drive connection to the drill.

19 Claims, 8 Drawing Figures

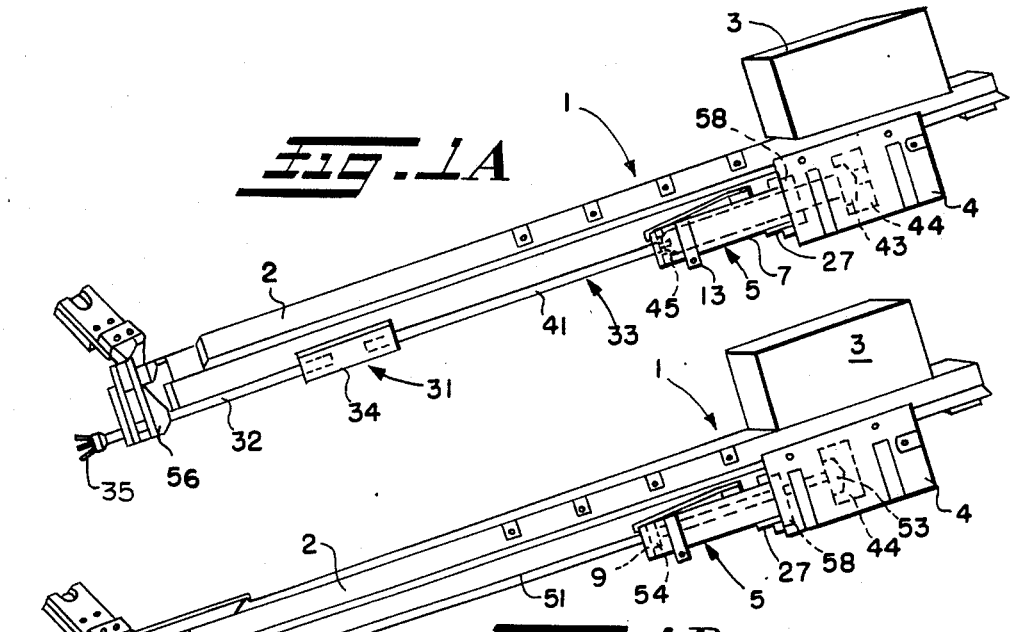
FIG. 1A
FIG. 1B
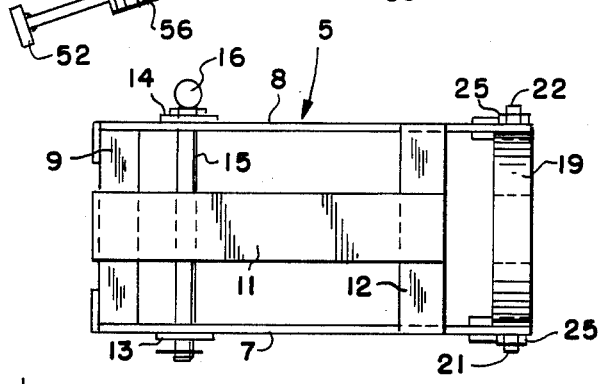
FIG. 3
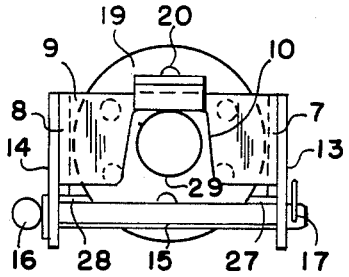
FIG. 5
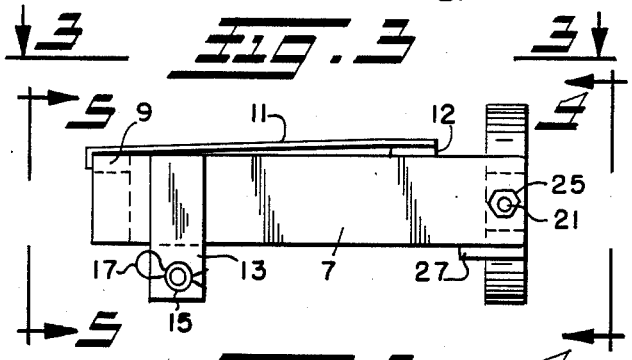
FIG. 2
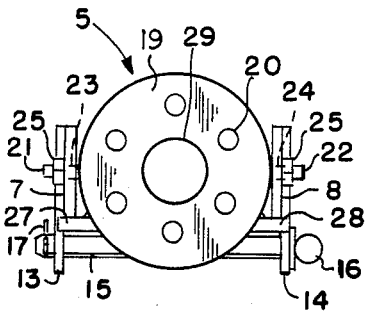
FIG. 4

APPARATUS AND PROCESS FOR TAPPING MOLTEN METAL FURNACES USING A ROTARY PERCUSSION MILL

FIELD OF INVENTION

The present invention relates to tapping molten furnaces using a rotary percussion drill in general and to an drilling rod, poking rod and cage assembly for mounting the same to the drill in particular.

BACKGROUND OF THE INVENTION

Molten metal furnace have tap holes therein to empty the furnaces at the conclusion of the metal heat. These tap holes are plugged with anhydrous tap hole clay which becomes very hard. In order to empty the furnaces, the plugged tap holes must be bored through by a drill to allow the moltern metal to pass therethrough.

Rotary percussion drills are used to bore through the anhydrous tap hole clay. The rotary percussion drills have a long slide mechanism associated therewith mounting a drill rod and drill bit for both rotary movement and hammering or percussion movement. The drill bit is made from carbide or other hardened metal and the drill rod is made from drill steel. When the drill bit penetrates the clay plug, the molten metal passes over and around the drill bit and drill rod to destroy or severly damage the same. This destruction or damage results in the relatively expensive drill bit and drill rod having to be replaced for substantially every heat of the furnace.

SUMMARY OF THE INVENTION

The principal object of the present invention is to provide an apparatus and method for drilling the plugged tap hole of a molten metal furnace without destroying or damaging the expensive drill bit and drill rod. To this end, the drilling rod with drill bit is used to drill the plugged tap hole to the furnace skull. The drilling rod and drill bit are removed from the rotary percussion drill. A poking rod and poking bar, which are made from relatively inexpensive carbon steel, are then installed on the rotary percussion drill to break through the molten metal skull to tap the furnace. The poking rod and poking bar are then removed from the drill and the drilling rod and drilling bit are the reinstalled to drill the tap hole after the next furnace heat.

It is another object of the present invention to provide a cage assembly on the rotary percussion drill drive box to facilitate installation and removal of the drilling rod or poking rod. The cage assembly is pivotally mounted to the drive box to provide additional clearance and gauidance in installing or removing the rods. The cage assembly includes a front end abutment plate cooperating with an abutment on either the poking rod or drilling rod to assist in providing a percussion drive connection with the rotary percussion drill. The cage assembly also includes a removable bottom bolt to facilitate installation and removal of the poking rod or drilling rod and to preclude inadvertent rod removal when installed.

It is yet another object of the present invention to provide a mounting means for either the drilling rod or the poking rod to facilitate rod installation. The mounting means includes a drive head on the back end of the rod being received in the drive box for a rotary connection and a forwardly spaced abutment (shoulder or taper) on the rod being positioned in close proximity to the front abutment wall of the cage assembly to assist in providing the percussion connection.

It is still another object of the present invention to provide a three piece drilling rod assembly having a selectively replaceable drill section. To this end, the drilling rod assembly may consist of a drilling section with drill bit, a mounting section and an intermediate coupling threadedly joining the drill section to the mounting section. The mounting section has the spaced drive head and tapered wall section on a striking bar threaded to a hollow tube in turn threaded to the intermediate coupling to allow the mounting section or parts thereof to be repeatedly used even though the drilling section may have to be replaced from time to time.

These and other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

BRIEF DESCRIPTION OF THE DRAWINGS

In the drawings:

FIG. 1A is a perspective of a rotary percussion drill having the cage assembly and drilling rod assembly with drill bit mounted thereon;

FIG. 1B is a perspective of the rotary percussion drill having the cage assembly and poking rod assembly with poking bar mounted thereon;

FIG. 2 is a side elevation of the cage assembly pivotally mounted on the flange;

FIG. 3 is a top plan view of the cage assembly and flange taken generally along the plane 3—3 in FIG. 2;

FIG. 4 is a rear end elevation of the flange and cage assembly taken generally along the plane 4—4 in FIG. 2;

FIG. 5 is a front end elevation of the cage assembly and flange taken generally along the plane 5—5 of FIG. 2;

DETAILED DESCRIPTION OF THE INVENTION

Figure 6:
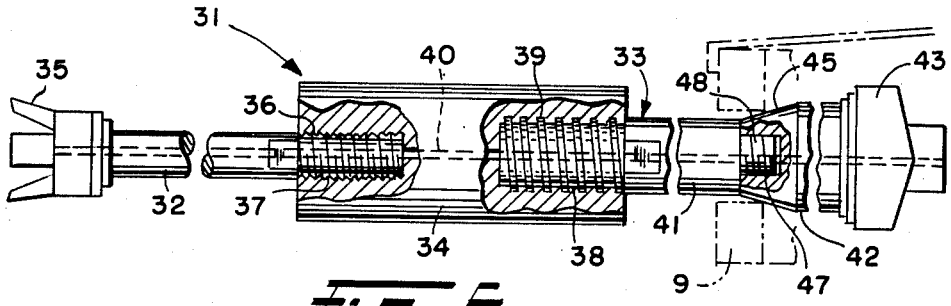
FIG. 6 is a side elevation of the drilling rod assembly and drilling bit, partially broken away and partially in section, showing the coupling between the drilling section and mounting section of the drilling rod and also showing part of the cage assembly in phantom lines.

Referring now in more detail to the drawings and intially to FIGS. 1A and 1B, a rotary percussion drill indicated generally at 1 includes an elongated inclined slide 2 supported at its forward and rear ends. A drive motor 3 is mounted on and extends upwardly from the rear end of the slide 2. The motor 3 drives the drilling rod or poking rod in both rotary and rectilinear or percussion movements through drive box 4 in conventional fashion. Drive box 4 is mounted on slide 2 for rectilinear reciprocal motion to provide the hammering or percussion movement of the drilling rod or poking rod. The percussion drill forms no part of the applicant's invention bu ti is the perferred equipment with which applicant's apparatus and method are used as described below.

Apparatus for Drilling the Plugged Hole

To assist in mounting the drill rod or poking rod, a cage assembly, which is indicated generally at 5, is pivotally mounted to the front end of drive box 4. The cage assembly includes two side walls 7 and 8 joined at their front end by front abutment wall 9. As best shown in FIG. 5, the front end abutment wall has an inverted U-shaped groove 10 therein to allow the drilling rod or poking rod to pass therethrough as described in more detail below. A top guide plate 11 is supported by the front end abutment wall 9 and extends backwardly to cross brace 12, which extends between side walss 7 and 8. The top guide plate 11 is inclined slightly upwardly from its forward end to its rear end as best shown in FIG. 2. Two longitudnally aligned ears 13 and 14 are respectively mounted on and extend downwardly from side walls 7 and 8. Ears 13 and 14 have aligned holes adjacent their bottom ends selectively to receive a containment bolt 15. The containment bolt 15 has a head 16 at one end thereof and a hole through its shank at the other end thereof selectively to receive cotter pin 17 to retain containment bolt 15 in position during operation.

The rear end of cage assembly 5 is pivotally mounted on the forward end of drive box 4. To this end, a flange 19 has a plurality of circumferentially spaced peripheral holes 20 receiving fasteners to secure the flange 19 to the drive box 4. The flange has diametrically opposed threaded pivot arms 21 and 22 extending horizontally outwardly therefrom. The threaded pivot arms 21 and 22 are respectively received in aligned holes 23 and 24 in the side walls 7 and 8 adjacent their respective rear ends. Nuts 25 are threaded onto the two pivot arms 21 and 22 to complete the pivotal connection between the flange 19 and the cage assembly 5.

The pivotal movement of the cage assembly is limited by stop members 27 and 28 welded to and extending horizontally outwardly from flange 19. Stop members 27 and 28 are respectively engaged by side walls 7 and 8 to limit their pivotal movement and thus the pivotal movement of the cage assembly 5 away from slide 2. The pivotal movement of the cage assembly is provided to assist in mounting the drilling rod or poking rod on the rotary percussion drill 1, and a central hole 29 is provided in flange 19 to allow the rear end of the drilling rod to pass therethrough.

The drilling rod assembly, which is indicated generally at 31, is preferably made in three sections including drill section 32, mounting section, indicated generally at 33, and coupling 34. The drilling section 32 includes a hollow drill steel tube having a carbide or other hard metal drill bit 35 on its front end. The rear end of the drill pipe forming the drilling section is threaded as shown at 36.

The threaded part 36 of drill pipe section 32 is screwed into a tapped hole 37 in one end of coupling 34. The other end of coupling 34 has a tapped hole 38 in axial alignment with tapped hole 37. Tapped hole 38 threadedly receives the forward end 39 of mounting section 33 of the drilling rod, which is formed of hollow drill steel or carbon steel tube. The two aligned tapped holes 37 and 38 in coupling 34 have bore 40 extending therebetween to provide air flow from the mounting section 33 through coupling 34 to drilling section 32 as will be described in more detail below.

The mounting section 33 of drilling rod assembly 31 includes a hollow tube 41 and a mounting means of its rear end selectively to couple the drilling rod assembly 31 to the drive box 4. The mounting means includes a striking bar 42 having a drive head 43 at its rear end. The drive head 43 has a polygonal peripheral configuration for receipt in a complementary polygonally configured socked 44 in drive box 4 to provide the rotary drive connection. The front end of striking bar 42 has a tapered wall section 45. The tapered wall section 45 is spaced forwardly from the drive head 43 and has a radial extent larger than the U-shaped opening in front abutment wall 9 of cage 5 forming a shoulder selectively abutting the front wall 9 of cage 5 to provide the percussion connection with the drill box 4, as best shown in FIG. 6. The front end of the striking bar 42 has a tapped hole 47 threadedly to receive the threaded male shank 48 on the rear end of hollow tube 41. The mounting section 33 of drill rod 31 can thus be disassembled by unthreading the rear end of tube 41 from the front end of striking bar 42.

Figure 7:
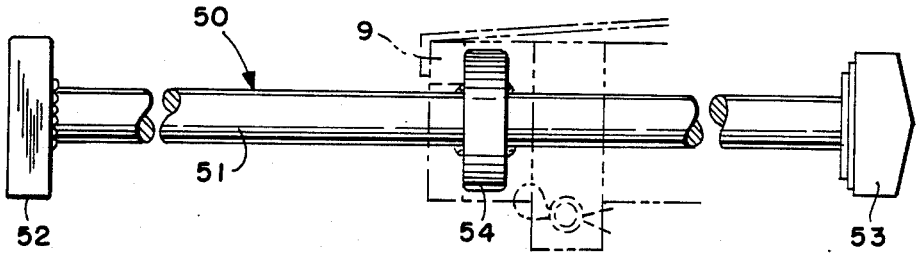
FIG. 7 is a side elevation of the poking rod assembly with poking bar, partially broken away and showing part of the cage assembly in phantom lines.

Turning now to FIG. 1B and FIG. 7, the poking rod assembly, indicated generally at 50, includes an elongated one piece carbon steel rod 51 having a poking bar 52 welded to its forward end at right angles. The poking rod 51 may be solid or hollow. The rear end of poking rod 51 includes a mounting means selectively to connect the poking rod to the drive box 4.

Specifically, the mounting for poking rod assembly 50 includes a polygonal drive head 53 at its rear end and an annular washer forming shoulder 54 fixed to the poking rod 51 forwardly from the drive head 53. The spacing between the drive head 53 and annular shoulder 54 conforms to the spacing between the socket 44 in drive box 4 and the front wall abutment 9 of cage assembly 5. Thus, when the drive head 53 is received in the drive socket 44 of drive box 4, the shoulder 54 on poking rod 51 is in engagement with or in close proximity to the front end abutment wall 9 of cage assembly 5, as best shown in FIG. 7. The engagement between shoulder 54 and front wall abutment 9 precludes longitudnal movement of the poking rod assembly 50 relative to the drill 1 and thus provides the percussion connection to the drive box 4 of the rotary percussion drill 1. As thus mounted, the pushing rod extends through the U-shape groove 10 in the front end abutment wall. The pushing rod assembly 50 is supported at its rear end by the drive head connection and is supported at its forward end by a J-hook 56. The J-hook encircles approximately 270° of the poking rod 51 (or the drilling rod) and thus provides support for the same while permitting facile installation and removal of the rods.

Method of Tapping the Plugged Tap Hole

The description of the method for using the apparatus just described begins with the drilling rod mounted on the drill as shown in FIG. 1A. The rotary percussion drill is then actuated to rotate and reciprocate the drill bit 35. The reciprocal movement of the drill bit to provide the hammering effect is provided by drive box 4 being reciprocally driven on slide 2 in known fashion. The drill bit 35 is rotated and advanced through the hardened clay in the tap hole, with air being blown through the hollow drill rod and coupling bore to remove dust and debris from the drill bit during drilling. The advancement of drill bit 35 is continued until sparks are observed. At this time, air is contacting the molten metal to form a parially solidified or oxidized skull layer. The drill bit 35 is then retracted from the tap hole, and drilling rod assembly 31 is removed from the rotary percussion drill 1.

To obtain removal, the lower containment bolt 15 of cage assembly 5 is removed after withdrawing cotter pin 17. The forward end of drilling rod assembly 31 is then lifted off J-hook 56. The drilling rod assembly 31 is then pulled forwardly to withdraw the draw head 43 from the drive box 4 through hole 29 in flange 19. When the drive head 43 clears flange 19, the drilling rod assembly 31 can be removed from cage assembly 5 and placed in a convenient storage location before installing the poking rod assembly 50.

To install poking rod assembly 50, the forward end of rod 51 is first inserted in J-hook 56. The drive head 53 of poking rod assembly 50 is longitudinally rearwardly advanced toward hole 29 in flange 19. The cage assembly 5 can pivot upwardly out of the way around pivot arms 21 and 22 to provide additional clearance for inserting drive head 53 in drive box 4. The top guide plate 11 of the cage assembly assists in directing the drive head 53 toward the hole 29 in flange 19 by acting as a lead-in ramp. A washer or collar 58 mounted in drive box 4 can also be used to assist in guiding drive head insertion. When the drive head 53 is received in drive socket 44 of the rotary percussion drill, the shoulder 54 has cleared the front wall abutment 9 of cage assembly 5 allowing the cage assembly to pivot downwardly under gravity to the position resting on stops 27 and 28 as best shown in FIG. 1B. In such position, the rotary connection with the rotary percussion drill is obtained by drive head 53 being received in the drive socket 44 and the percussion connection with the drill is formed by shoulder 54 engaging the front wall abutment 9 of cage assembly 5. The bottom containment bolt 15 of cage assembly 5 may then be reinstalled and held in place by cotter pin 17 to preclude the poking rod assmbly 50 from inadvertently falling out of the cage assembly 5.

With the poking rod assembly 50 thus mounted, the poking bar 52 on poking rod 51 is then advanced by actuating drill 1 to push through the furnace skull. This allows the molten metal to pass through the bored tap hole clay to tap the furnace. When the skull is punctured or broken, the poking bar 52 is quickly withdrawn from the tap hole. The poking bar assembly 50 is then removed from the rotary percussion drill, and the drilling rod assembly 31 reinstalled to prepare for drilling the replugged tap hole after the next furnace heat.

By drilling the tap hole only to the furnace skull with the drilling rod assembly 31, the drill bit 35 and drill steel section 32 can be reused several times before being replaced. The drill bit 35 and drill rod steel 32 have minimum exposed to and are not submerged in molten metal which allows the reuse of these relatively expensive components. When replacement is necessary, the drill rod 32 with attached drill bit 35 can be screwed out of coupling 34 and a new drill section screwed into place on coupling 34. This allows the coupling 34 and mounting section 33 to be continually reused without replacement.

Similarly, the poking rod 51 with attached poking bar 52 are only penetrating the relatively soft furnace skull. Therefore, even though the poking rod and poking bar may be exposed to or submerged in the molten metal, any damage to the same is not as important since reuse will be possible for at least a few heats and since the poking rod and poking bar are made of relatively inexpensive and easily replaced carbon steel.

By using the foregoing apparatus and process, the drilling rod assembly and poking rod assebly are easily removed from and installed on the rotary percussion drill. The expensive drill bit and drill steel used on the drilling rod section of the drilling rod asssembly have increased operational life since they can be reused for multiple furnace heats. The less expensive poking rod can also be reused for several heats because of the ease with which the furnace skull can be penetrated by the poking bar.

It will be apparent from the foregoing that changes may be made in the details of construction and configuration without departing from the spirit of the invention as defined in the following claims. For example, the drilling rod assembly could be provided with a shoulder, such as shoulder 54, cooperatively to form the percussion connection with cage assembly 5 instead of the tapered wall section 45 on striking bar 42.

I claim:

1. Apparatus for tapping a plugged tap hole in a molten metal furnace using a rotary percussion drill having a drive box mounted for reciprocal rectilinear movement on a slide comprising a cage assembly having pivot means for pivotally connecting the cage assembly to the drive box and a forward end abutment, a drilling rod assembly having a drill bit at its forward end and first mounting means at its rear end for removably coupling the drilling rod assembly to the drive box with a drive connection for drilling the plugged tap hole to the furnace skull and a poking rod assembly having a poking bar at its forward end and second mounting means at its rear end for removably coupling the poking rod assembly to the drive box with the drive connection to poke through the furnace skull to tap the furnace, said first and second mounting means each including a drive head to provide a rotatable connection with the drive box and a spaced annular shoulder in close proximity to the forward end abutment of the cage assembly to provide a percussion connection with the drive box, and a containment member removably connected to the cage assembly to retain the first or second mounting means in the case assembly.

2. The apparatus as set forth in claim 1 wherein said pivot means comprises a flange secured to the forward end of the drive box and diametrically opposed pivot arms extending horizontally and radially outwardly from the flange.

3. The apparatus as set forth in claim 2 wherein the flange has a central hole therethrough large enough to allow the drive head to pass therethrough into the drive box.

4. The apparatus as set forth in claim 3 wherein the drilling rod assembly and poking rod assembly respectively include a drilling rod and a poking rod wherein the forward end abutment of the cage assembly has an inverted U-shaped groove therein large enough to allow the drilling rod or poking rod to pass therethrough but small enough to result in the annular shoulder engaging the forward end abutment.

5. The apparatus as set forth in claim 2 wherein the cage assembly has two spaced sidewalls joined in the front by the forward end abutment, said walls having aligned holes adjacent their rear ends respectively to receive the pivot arms of the flange to form the pivotal connection of the cage to the drive box.

6. The apparatus as set forth in claim 4 wherein the flange has bottom stop members thereon to limit the pivotal movement of the cage assembly relative to the drive box 7. The apparatus as set forth in claim 5 wherein a removable bottom containment member selectively extends across the cage assembly side walls to contain the portions of the drilling rod or poking rod received in the cage assembly.

8. The apparatus as set forth in claim 6 wherein the cage assembly has a top plate acting to guide the drilling rod or poking rod during insertion and removal.

9. The apparatus set forth in claim 1 further including a J-shape hook mounted on and extending downwardly from the slide in spaced relation from the drive box selectively to provide support for the drilling rod or poking rod.

10. The apparatus as set forth in claim 1 wherein the drilling rod assembly includes a mounting section having the first mounting means thereon, a drilling section of drill steel having the drill bit thereon and a coupling therebetween threadedly to join the mounting section to the drilling section.

11. The apparatus set forth in claim 10 wherein the mounting section includes a striking bar threadedly connected to a hollow drill tube.

12. The apparatus set forth in claim 11 wherein the striking bar has the drive head formed on its rear end and a tapered wall section formed on its front end, the tapered wall section selectively acting as the shoulder in engagement with the forward end abutment.

13. The apparatus set forth in claim 1 wherein the poking rod and/or poking bar are made of carbon steel.

14. The apparatus set forth in claim 1 wherein the poking rod assembly includes a poking rod and the shoulder is formed by an annular washer secured to the poking rod.

15. The apparatus set forth in claim 1 wherein the drilling rod assembly includes a tapered wall section forming the shoulder selectively engaging the forward end abutment.

16. An apparatus for tapping molten metal furnaces having plugged tap holes using a rotary percussion drill with a drive box comprising a cage assembly pivotally mounted to the drive box and having a front abutment wall, a removably poking rod assembly to puncture the skull in the tap hole to tap the furnace having on one end a poking bar and on the other end a drive head to provide a rotatable connection with the drive box and a spaced annular shoulder in close proximity to the front abutment wall of the cage assembly to provide a percussion connection with the drive box, and a containment member removably connected to the cage assembly to retain the drive head and spaced annular shoulder in the cage assembly.

17. The apparatus as set forth in claim 16 further including a drilling rod assembly with drilling bit removably secured to the drive box and cage assembly to drill the plugged tap hole to the furnace skull.

18. An method for tapping molten metal furnaces using a rotary percussion drill having a pivotally connected cage assembly and a containment member removably mounted on the case assembly comprising the steps of drilling a plugged furnace tap hole to the furnace skull using a drilling rod assembly with drill bit, removing the containment member to provide clearance, pivoting the cage assembly out of position to allow the removal of the driling rod assembly, removing the drilling rod assembly with drill bit from the rotary percussion drill, installing a poking rod assembly with poking bar on the rotary percussion drill, pivoting the cage assembly in position to secure the poking rod assembly on the rotary percussion drill, installing the containment member to retain a portion of the poking rod assembly within the cage assembly and breaking the furnace skull using the poking bar on the poking rod assembly.

19. The method set forth in claim 18 comprising the further step of periodically replacing the drill bit on the drilling rod assembly as required by drill bit wear.

* * * * *